US010655320B2

(12) United States Patent
Schrentewein

(10) Patent No.: US 10,655,320 B2
(45) Date of Patent: May 19, 2020

(54) CONNECTION SYSTEM WITH CONNECTOR PIECE FOR TIMBER CONSTRUCTION

(71) Applicant: ROTHO BLAAS GMBH/SRL, Bolzano (IT)

(72) Inventor: Thomas Schrentewein, Bolzano (IT)

(73) Assignee: ROTHO BLAAS GMBH/SRL, Bolzano (IT)

( * ) Notice: Subject to any disclaimer, the term of this patent is extended or adjusted under 35 U.S.C. 154(b) by 0 days.

(21) Appl. No.: 16/476,565

(22) PCT Filed: Jan. 10, 2018

(86) PCT No.: PCT/EP2018/050527
§ 371 (c)(1),
(2) Date: Jul. 9, 2019

(87) PCT Pub. No.: WO2018/130551
PCT Pub. Date: Jul. 19, 2018

(65) Prior Publication Data

US 2019/0338510 A1 Nov. 7, 2019

(30) Foreign Application Priority Data

Jan. 11, 2017 (IT) ..... 202017000002109

(51) Int. Cl.
*E04B 1/26* (2006.01)

(52) U.S. Cl.
CPC .... *E04B 1/2608* (2013.01); *E04B 2001/2644* (2013.01); *E04B 2001/2652* (2013.01)

(58) Field of Classification Search
CPC ..... E04B 2001/2644; E04B 2001/2652; E04B 1/2608
See application file for complete search history.

(56) References Cited

U.S. PATENT DOCUMENTS 4,480,941 A 11/1984 Gilb et al.
5,467,570 A 11/1995 Leek
(Continued)

FOREIGN PATENT DOCUMENTS

DE 296 10 381 U1 9/1996
DE 29718172 U1 * 11/1997 ..... E04B 1/2608
(Continued)

OTHER PUBLICATIONS

International Search Report, dated Apr. 12, 2018 (2 pages).

*Primary Examiner* — Babajide A Demuren
(74) *Attorney, Agent, or Firm* — Jacobson Holman, PLLC.

(57) ABSTRACT

A connecting system for wood constructions, having a connecting piece which is a metal plate bent substantially 90°+−5° to form an angle piece, the connecting piece has a row of holes connecting a first wood construction part to a second wood construction part, the two wood construction parts form a substantial right angle, the connecting piece is fastened with a first row of full-thread screws, introduced into the holes at an angle (a) between 60°−85° formed by the screw and the plate in which the holes are arranged, the holes are arranged substantially adjacent the fold with a maximum spacing of 25 mm, the connecting piece is fastened with a second row of nails and/or screws in holes and have a length less than that of the first row of full-thread screws and are introduced substantially perpendicularly into the holes with respect to the corresponding plate.

10 Claims, 2 Drawing Sheets

(56) References Cited

U.S. PATENT DOCUMENTS

| | | | | |
|---|---|---|---|---|
| 2011/0005145 | A1* | 1/2011 | Contasti | E04B 1/2608 52/98 |
| 2013/0334392 | A1* | 12/2013 | Hill | F16M 13/00 248/500 |

FOREIGN PATENT DOCUMENTS

| | | | | | |
|---|---|---|---|---|---|
| DE | 29903956 | U1 * | 10/1999 | | E04B 1/2608 |
| DE | 20 2004 006 321 | U1 | 6/2004 | | |
| EP | 2 093 335 | A2 | 2/2009 | | |
| EP | 2 093 336 | A2 | 2/2009 | | |
| FR | 1469500 | A * | 2/1967 | | E04B 1/2608 |
| GB | 2487938 | A * | 8/2012 | | E04B 1/2608 |
| JP | 6-49901 | A | 2/1994 | | |
| JP | 9-41523 | A | 2/1997 | | |
| WO | WO-2005052390 | A1 * | 6/2005 | | F16B 15/0053 |

* cited by examiner

CONNECTION SYSTEM WITH CONNECTOR PIECE FOR TIMBER CONSTRUCTION

BACKGROUND OF THE INVENTION

The present invention relates to a connection system with a connector piece for use in timber constructions, which is composed of a metal angle section having dowel-type joints, i.e. nails and fully threaded screws, and a system using such connector piece.

Typically known connection devices for timber constructions are in the form of a metal angle section, to provide structural connection between one or more wooden parts.

Patent U.S. Pat. No. 5,467,570 (title: Tension tie, Proprietor: Simpson Strong-Tie Co., Inc.) discloses a connector piece that is subjected to tension forces and is adapted to connect wood, or steel structural parts to a reinforced concrete structural base member. (Holdown). Such US publication discloses side reinforcements to brace the structure against parallel or shear stresses.

Patent EP2093335A2 (title: One-piece angle bracket for fastening a first construction element to a second construction element, Proprietor: Simpson Strong-Tie Co., Inc.) discloses a connector piece in the form of an angle section with a central reinforcement, which is adapted to prevent deformation in case of stresses parallel to the folding axis (shear in the plane) to connect structural wooden parts.

Patent EP2093336A2 (title: Angle bracket for fastening a first construction element to a second construction element and method for producing an angle bracket, Proprietor: Simpson Strong-Tie Co., Inc.) discloses a connector piece in the form of an angle section with side reinforcements, adapted to prevent deformation in case of stresses parallel to the folding axis (shear in the plane) to connect structural wooden parts.

Patent DE202004006321U1 (title: Winkelverbinder für Holzkonstruktionen, Pr: GH-Baubeschläge GmbH), Proprietor: Simpson Strong-GmbH) discloses a connector piece in the form of an angle section with multiple reinforcements, adapted to deformation in case of stresses parallel to the folding axis (shear in the plane) to connect structural wooden parts.

The prior art still suffers from certain drawbacks. Various connector pieces are needed to absorb stresses, namely perpendicular (tension) and parallel (shear) to the folding axis, especially in CrossLam timber buildings, also known as XLAM or CLT. The aforementioned connection member for tension stresses (holdown), when used in a wood-to-wood (e.g. wall-to-floor) joint requires the solid wood walls of the upper floor to have the same thickness as those of the lower floor. Finally, in order to increase the stiffness of the angle section, due to stresses parallel to the folding axis, the prior art always uses different types of reinforcements, while optimizing the thickness of the angle section.

Reinforcements are needed to ensure resistance, but entail high manufacturing costs and may cause the connector piece to have a greater bulk.

SUMMARY OF THE INVENTION

The object/scope of the present invention is to obviate the prior art drawbacks.

In particular the present invention has the object of providing a connector piece for timber constructions as described hereinbefore, that allows a single device to be used for various stresses (tension and shear in the plane). Another object of the present invention is to greatly increase the strength and rigidity of the connection system for very high stresses, e.g. those resulting from seismic events or by gusts of wind.

To fulfill the above purposes, the invention provides a novel connector piece for timber constructions in the form of a metal angle section with a particular arrangement of the holes for the dowel-type fasteners, i.e. nails and fully threaded screws.

This object/scope is achieved by a connection system with a connector piece for timber constructions, which is composed of a first metal plate, preferably made of steel. The thickness of the steel preferably ranges from 3 mm to 6 mm, and is advantageously 4 mm. The plate is bent at an angle of substantially 90° to form an angle section. The vertical side of the plate of the connector piece is formed with a series of holes whose diameter ranges from 4 mm to 6 mm, and is preferably 5 mm; the horizontal side is formed with a first series of holes whose diameter d ranges from 4 mm to 6 mm, and is preferably 5 mm. The horizontal side of the connector piece, near the 90° folding axis, at a distance i between the folding axis and the center of the hole, is formed with a second series of holes whose diameter n ranges from 11 mm to 13 mm, and is preferably 12 mm. The first holes having the smaller diameter are adapted to receive smooth or grooved nails, screws or similar, whereas the second holes having the greater diameter are adapted to receive fully threaded screws, that form an angle a ranging from 60° to 85°, preferably 75°, with respect to the horizontal plane.

This arrangement of the fully threaded screws results in a surprising effect and stiffens the entire connection, thereby affording greater strength.

Furthermore the object is fulfilled by means of a connection consisting of a connector piece of the invention.

Unlike the prior art, the connector piece can be used for stresses both perpendicular (tension) and parallel (shear in the plane) to the folding axis, and is well-suited for advanced structural calculations that account for these multiple stresses. The connector piece in the form of a metal angle section requires no additional reinforcement between the two flanges, because the fully threaded screws in the assembly of wooden parts prevent any deformation caused by stresses parallel to the folding axis. The connector piece can receive a large number of nails to meet the strength and stiffness requirements associated with very high stresses resulting from earthquakes or wind. The connector piece has a small height, which provides the advantage that it does not extend above the subfloor parts. The connector piece hereof is optimized for CrossLam timber buildings (XLAM, CLT) and affords simplified assembly of the timber construction.

This combination of small nails/screws or similar and fully threaded screws can surprisingly stop stresses both perpendicular and parallel to the folding axis.

DESCRIPTION OF THE DRAWINGS

The invention will be now described in further detail, based on the description of a preferred, not exclusive embodiment that is schematically shown by way of illustration and without limitation in the accompanying figures.

SUMMARY OF THE INVENTION

Figure 1:
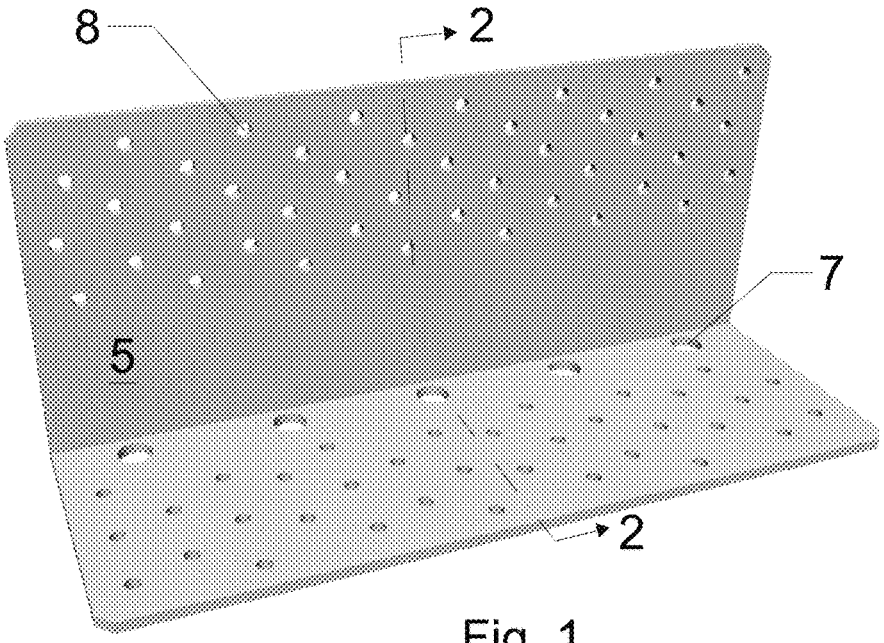
FIG. 1 schematically shows a front perspective view of the connector piece.
Figure 2:
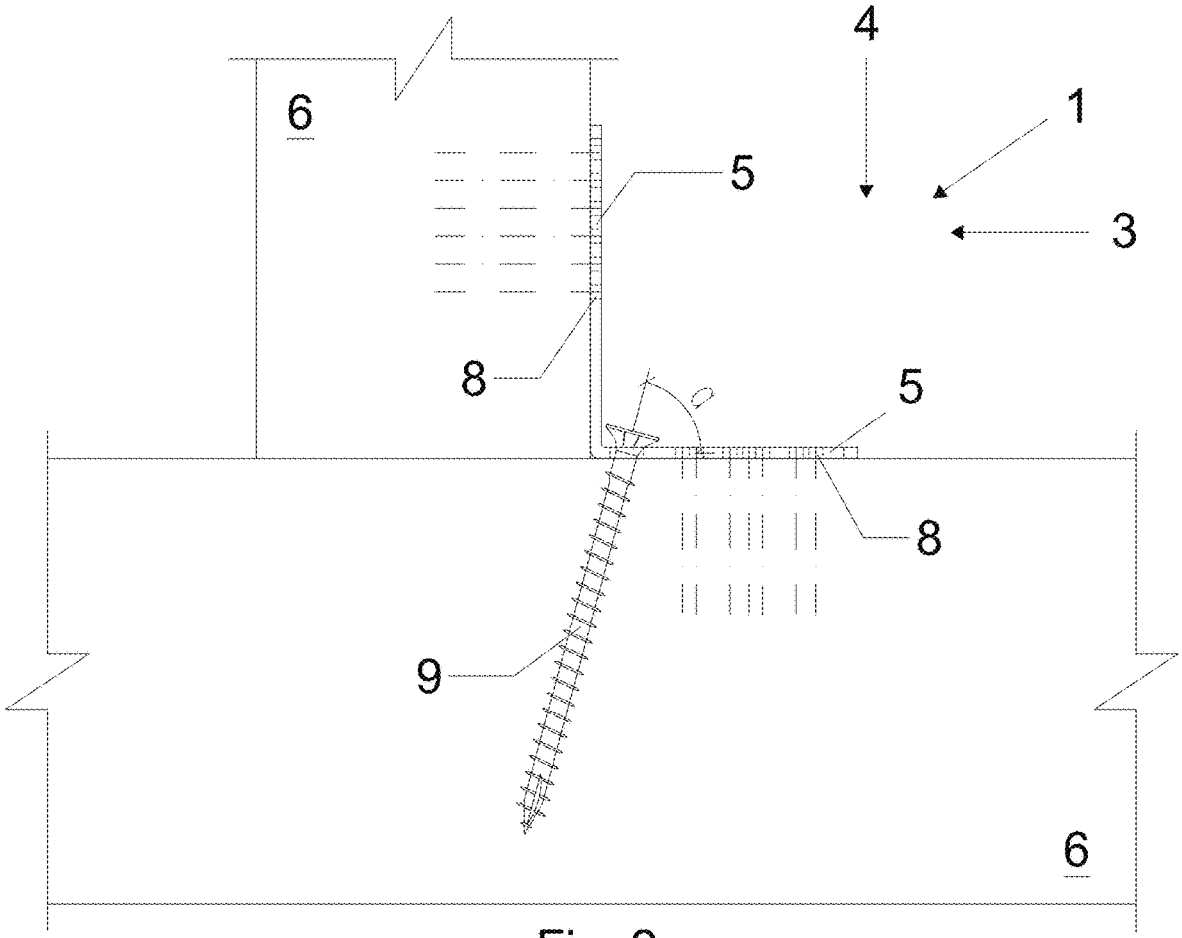
FIG. 2 shows an enlarged section of views along line 2-2 of FIGS. 1, 3 and 4 of the connector piece connected to the wooden parts 6, i.e. a wall and a floor.

As shown in FIG. 2, which is a section taken along the line 2-2 of FIG. 1 the connector piece 1 is composed of a metal plate 5, preferably made of steel, with a thickness that preferably ranges from 3 mm to 6 mm, and is advantageously 4 mm, folded at an angle of substantially 90°+−5° to form an angle section.

The plate 5 is divided by folding axis into a vertical part of the plate 3 and a horizontal part 4. The vertical side 3 of the connector piece is formed with a series of first holes 8 whose diameter d preferably ranges from 4 mm to 6 mm, and is advantageously 5 mm; the horizontal side, e.g. In one embodiment, is formed with 35 holes 8 whose diameter d ranges from 4 mm to 6 mm, and is advantageously 5 mm. The horizontal side of the connector piece, near the 90° folding axis is formed with a second series of holes 7 having a greater diameter n, preferably ranging from 9 mm to 15 mm, and advantageously 12 mm. The first holes 8 with the diameter d are adapted to receive smooth or grooved nails, screws or similar, whereas the second holes 7 with the diameter n are adapted to receive fully threaded screws, that form an angle a ranging from 60° to 85°, advantageously 75°, with respect to the horizontal plane.

Figure 3:
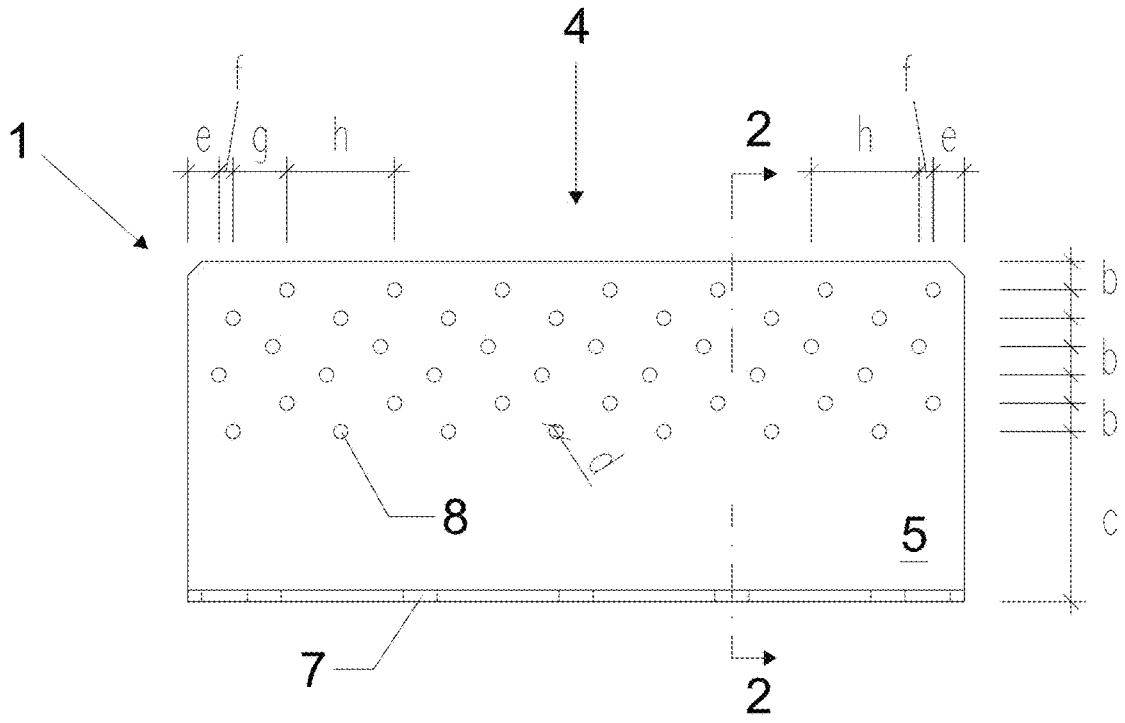
FIG. 3 shows a front view of the connector piece.

FIG. 3 shows the distance b of the holes 8 from the upper edge and the same distance b between the holes, which may be, for example, 10 mm. The distance c of the holes 8 from the lower edge is, for example, 60 mm. The distance of the holes 8 from the left and right edges is advantageously 11 mm. In a preferred embodiment, the holes 8 in the vertical direction are offset by a distance f, advantageously 5 mm. The vertical rows of holes 8 are arranged with a center-to-center distance g, advantageously 19 mm. The distance h between the holes 8 in the horizontal direction is preferably 38 mm.

Figure 4:
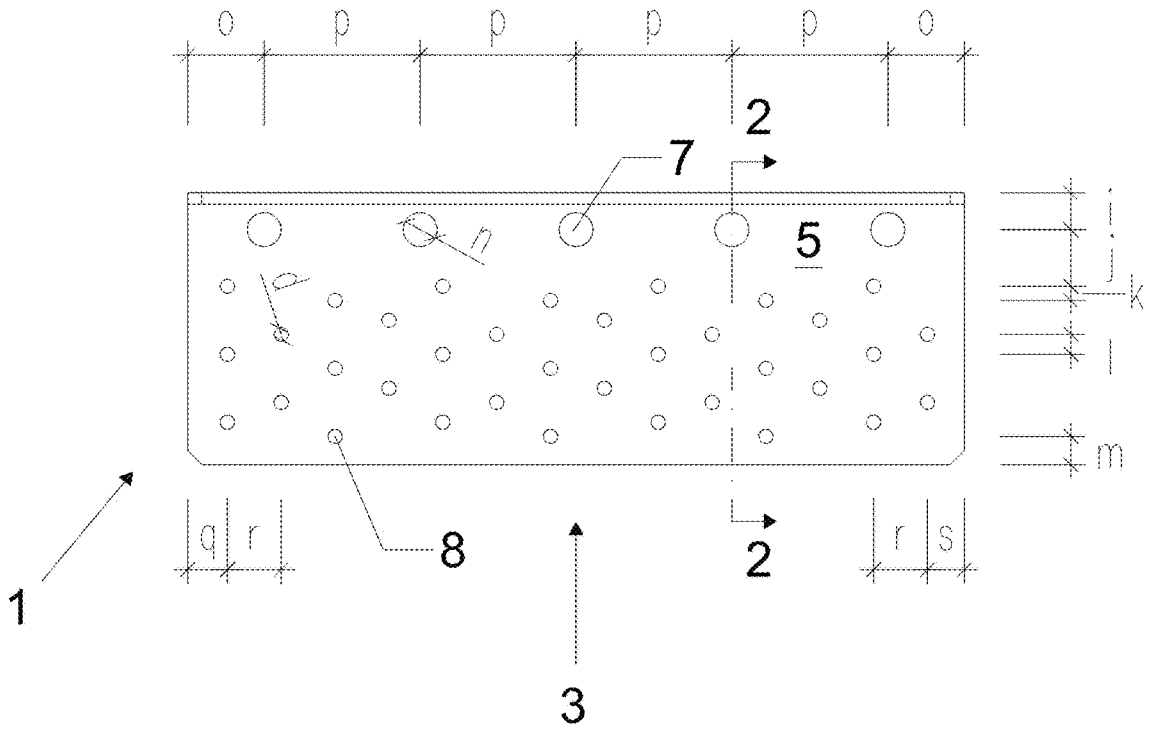
FIG. 4 shows a top view of the connector piece.

FIG. 4 shows, according to a preferred example, the distance of the center of the holes 7 from the outer edge of the vertical side, which in this example is about 13 mm. The distance j between the holes 7 and the holes 8 is advantageously 20 mm. The holes 8 of the row on the horizontal side of the element are offset by a distance k, advantageously 5 mm. The minimum distance between the rows of the holes 8 may be, for example, the distance l of 7 mm. The distance m of the holes 8 from the opposite edge of the vertical side of the connector piece may be 10 mm. The distance of the holes 7 from the left and right edges is advantageously at least or exactly 27 mm. The distance p between the holes 7 in the horizontal direction is advantageously at least or exactly 55 mm. The distance q of the holes 8 from left edge is for example 14 mm, and the distance s from the right edge is for example 13 mm. The vertical rows of holes 8 are offset in the horizontal direction by a distance r, for example 19 mm.

Advantageously, the connection system formed by a connection consisting of a connector piece of the invention which connects a first wooden construction part 6 with a second wooden construction part. The two elements form a substantially right angle. The connector piece is fastened with a first series of fully threaded screws, which fit into the holes 7 at an angle a ranging from 60° to 85° formed by the screw and the plate with the holes, advantageously about 75°. These holes are arranged substantially adjacent to the folding line at a distance of not more than 25 mm, advantageously 5 mm. The connection is secured with a second series of nails and/or screws in the holes 8. These second screws/nails have a smaller diameter than the first series of fully threaded screws, which and fit into the holes substantially perpendicularly to their respective plate and into the two wooden construction parts.

Advantageously the fully threaded screws do not require a washer/ring to be interposed between the plate and their head.

It will be finally appreciated that the system and connector as described heretofore are susceptible of additions, changes or variants that would be obvious to the skilled person, without departing from the scope of the invention as defined by the appended claims.

LIST OF REFERENCE NUMBERS

1 connector piece
2 section line, 2-2
3 lower plate part
4 upper plate part
5 metal plate
6 wooden construction part
7 hole
8 hole
9 fully threaded screws
a angle
b,p,h,g,r,k,l,f distance between holes
e,o,q,s distance of holes from edge
l,c distance of holes from folding axis
j distance between first and second holes
d,n diameter of holes

The invention claimed is:

1. A connection system for timber constructions, composed of a connector, which is a metal plate folded at an angle of substantially 90°+ or—5° to form an angle section, the plate of the connector piece having a series of holes connecting a first wooden construction part with a second wooden construction part, the two construction parts forming a substantially right angle and the connector piece being fastened with a first series of fully threaded screws fitted into holes at an angle ranging from 60° to 85°, formed by the screw and the plate with the holes, these holes being arranged substantially adjacent to a folding line of the connector piece at a distance of not more than 25 mm, the connector piece being fastened with a second series of nails and/or screws in holes, said second series of nail and/or screws having a smaller length relative to the first series of fully threaded screws and fitting into the holes substantially perpendicular to their respective plate and into the two wooden construction parts.

2. The connection system for timber constructions as claimed in claim 1, wherein the first series of fully threaded screws fit into the holes at an angle ranging from 60° to 85°, formed by the screw and the plate with the holes and these holes are arranged substantially adjacent to the folding line, at a distance of not more than 5 mm.

3. The connection system for timber constructions as claimed in claim 1, wherein the angle is substantially 75°.

4. The connection system for timber constructions as claimed in claim 1, wherein the second series of screws/nails fitting into the second holes have a smaller diameter than the first series of fully threaded screws.

5. The connection system for timber constructions as claimed in claim 1, the two wooden construction parts are crosslam (XLAM,CLT).

6. A connector piece for constructions for use in a system as claimed in claim 1, wherein it consists a metal plate that is folded at an angle of substantially 90°+ or −5° to form an angle section, a first side of the plate of the connector piece being formed with a first series of holes whose diameter ranges from 4 mm to 6 mm; a horizontal side being formed with the first series of holes whose diameter ranges from 4 mm to 6 mm, the horizontal side of the connector piece, near the 90°+ or −5° folding axis, at a distance between the folding axis and the center of the holes, being formed with a second series of holes whose diameter ranges from 11 mm to 13 mm, the first holes with the smaller diameter being adapted to receive smooth or grooved nails or screws and the second holes being adapted to receive fully threaded screws that form an angle ranging from 60° to 85°, with the horizontal side.

7. The connector piece for constructions as claimed in claim 6, wherein the distance of the first holes from the left and/or right edge of the connector piece is at least 27 mm.

8. The connector piece for constructions as claimed in claim 6, wherein the distance between the first holes in the horizontal side is at least 55 mm.

9. The connector piece for constructions as claimed in claim 6, wherein the distance of the second holes from a left edge of the connector piece is 14 mm, while from a right edge is 13 mm.

10. The connector piece for constructions as claimed in claim 6, wherein vertical rows of the second series of holes are offset in a horizontal direction of the connector piece by a distance of 19 mm.

* * * * *